US006902084B2

(12) United States Patent
Bauman

(10) Patent No.: US 6,902,084 B2
(45) Date of Patent: Jun. 7, 2005

(54) CONTAINER DISPENSER

(76) Inventor: Barry B. Bauman, 1396 Highland Road West, Kitchener, Ontario (CA), N2N 3K6

( * ) Notice: Subject to any disclaimer, the term of this patent is extended or adjusted under 35 U.S.C. 154(b) by 175 days.

(21) Appl. No.: 10/602,856

(22) Filed: Jun. 25, 2003

(65) Prior Publication Data

US 2004/0000559 A1 Jan. 1, 2004

Related U.S. Application Data

(60) Provisional application No. 60/391,408, filed on Jun. 26, 2002.

(51) Int. Cl.[7] ..... B65G 59/00
(52) U.S. Cl. ..... 221/115; 221/131
(58) Field of Search ..... 221/155, 117, 221/116, 112, 132, 237, 277, 92, 123, 124, 131, 133

(56) References Cited

U.S. PATENT DOCUMENTS 3,158,289 A * 11/1964 Brunt ..... 221/116
5,000,344 A * 3/1991 Janssen ..... 221/92

* cited by examiner

*Primary Examiner*—Kenneth Noland
(74) *Attorney, Agent, or Firm*—Daryl W. Schnurr

(57) ABSTRACT

A dispensing machine stores and dispenses containers longitudinally within the machine up to the time that a container is released to the outlet. The containers are arranged in vertical columns within the machine with four adjacent columns making up one set. Each set has a separate motor and the machine has a maximum selection equal to the number of sets. Each set has an upper abutment and a lower abutment that together control the movement of containers of each set to the outlet in succession. The two abutments are located a distance of less than the height of one container apart from one another. The containers are narrower at a top than at a base.

26 Claims, 13 Drawing Sheets

CONTAINER DISPENSER

This application claims benefit of Provisional Application No. 60/391,408, filed Jun. 26, 2002.

BACKGROUND OF THE INVENTION

1. Field of Invention

This invention relates to a container dispenser and, more particularly, to a machine for automatically dispensing containers of beverages and the like.

2. Description of the Prior Art

Automatic dispensing machines are known and are used to dispense beverage containers as well as containers containing food. The beverage dispensers are by far the most common and machines are known for dispensing cans, glass bottles and plastic bottles. In the soda industry, glass bottles were replaced by cans many years ago and, today, plastic containers are replacing cans. The modem consumer is more health conscious and bottled water is extremely popular along with a host of non-carbonated flavoured water based beverages as well as fruit juices and sport drinks. Most containers for beverages have an elongated shape and plastic containers and soda cans have greater longitudinal strength than lateral strength. Vending machines for beverages typically store and move the containers through the machine horizontally. It is important to have a large number of selections on the machine as there are a large number of different products available. It is also important to have large storage facilities for each selection. Previous machines have a relatively low number of selections. Those previous machines that have a large number of selections have a low storage capacity for each selection or they are susceptible to becoming jammed, or they are too complex or expensive to manufacture.

Some previous vending machines jam frequently or the containers are damaged while they are moved within the machine or the machines fail too frequently.

SUMMARY OF THE INVENTION

It is an object of the present invention to provide a dispensing machine that stores the containers vertically within the machine and continues the vertical orientation up to the time that each container is released to the outlet. It is a further object of the present invention to provide a dispensing machine that can readily provide twelve or more selections. It is still a further object of the present invention to provide a dispensing machine of conventional size that stores twenty four or more containers for each selection when the machine has been filled with containers.

A container dispensing machine is used for automatically dispensing containers where each container has a base and a top with said top being smaller than said base. The dispensing machine comprises a plurality of vertical guides means arranged in at least one set, the vertical guides means being sized so that a plurality of containers can fit within each of the guide means longitudinally with said base being located beneath said top. There are two abutments rotatably mounted in a plane substantially normal to a longitudinal centre axis of the at least one set. An actuation is connected to rotate the two abutments by part of one turn in the plane for each activation. Each of the two abutments has a cutaway portion. The two abutments are an upper abutment and a lower abutment. The abutments are oriented so that the cutaway portion of the upper abutment is vertically offset from the cutaway portion of the lower abutment by at least the distance that the two abutments rotate in one activation. The abutments rotate about the longitudinal centre axis of the at least one set. The upper abutment is sized to rotate without damaging the containers on the lower abutment, the abutments being separated by less than a height of one container. The vertical guides have an opening therein corresponding to a level of the upper abutment to allow the upper abutment to pass through the vertical guides. The dispensing machine has an outlet for any containers that pass the lower abutment.

Preferably, the vertical guides are a plurality of tubes, said tubes being arranged in a set with two abutments for each set.

A method of dispensing containers from a dispensing machine stores and dispenses containers longitudinally from vertical guides within a housing of the machine. The containers have a base and a top with the top being smaller than the base. The method comprises arranging a plurality of vertical guides in at least one set, locating two abutments and a plane normal to a longitudinal centre axis of the at least one set, mounting the abutment vertically apart from one another by a distance that is less than a height of one container, locating a cutaway portion in each abutment, offsetting the cutaway portions from one another, locating the abutment on an actuator to rotate the abutments, filling the guides with containers and activating the actuator to dispense containers from the at least one set at the rate of one container for each activation.

DESCRIPTION OF A PREFERRED EMBODIMENT

Figure 1:
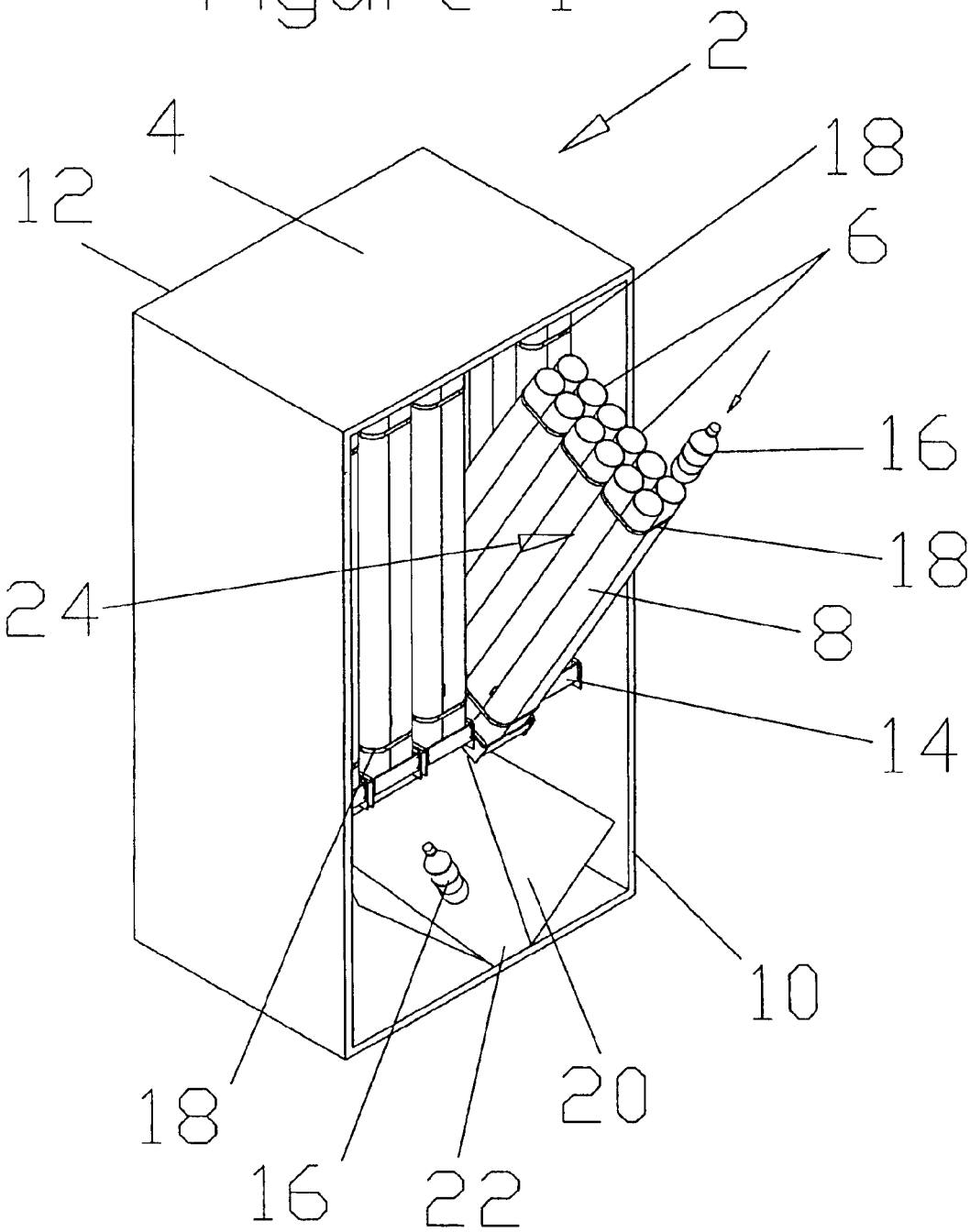
FIG. 1 is perspective view of a dispensing machine having a housing containing fifteen sets of tubes.

In FIG. 1, there is shown a dispensing machine 2 having a housing 4 containing fifteen sets 6 of tubes 8. The housing 4 has a front 10 and a rear 12. A door (not shown) of the housing 4 has been omitted. The door would be hinged to a front 10 of the housing 4 to provide access to an interior of the housing 4. The refrigeration equipment and the wiring of the dispensing machine are considered to be conventional and are not described.

The sets 6 are arranged in five clusters of three sets each mounted side by side within the housing 4. Each cluster 24 of three sets extending from front to rear of the housing 4 is mounted on a tiltable support 14. The second cluster from the right in FIG. 1 is tilted forward as shown. In the tilted forward position, all of the tubes 8 within the cluster of three sets can be filled with containers 16 by placing the containers longitudinally into a top of each of the tubes 8. Each container has a top and a base and the top is smaller than the base. The containers are placed right side up in the tubes 8 with the base of each container located beneath the top. When all of the tubes of all of the sets of the tilted forward cluster have been filled with containers, that cluster is tilted back into the housing. A second cluster of three sets of tubes is then tilted forward and those tubes are filled with containers. This process is repeated until all the clusters of three sets each have been tilted forward and filled with containers. By filling the machine in an orderly fashion with a different beverage in each set of four tubes, the dispensing machine 2 can provide a selection of fifteen different beverages. In some cases, an operator of the dispensing machine may decide to place a more popular beverage in more than one set. Also, an operator might decide to set up the machine with fewer than fifteen selections so that each beverage occupies more than one set of the machine and the machine is designed to activate each of the sets for the same beverage in succession until all of the sets for that selection are empty.

Each set 6 of four tubes 8 is bound together near a top and bottom by straps 18. A chute 20 extends beneath the tubes 8 to carry any container 16 passing through any of the tubes to an outlet 22. The container 16 shown on the chute 20 is shown for purposes of illustration only. Preferably, the machine will not be operable when a group of tubes is tilted forward. An operator may want the machine to be operable when the door is open for testing or start-up purposes. Also, the machine is preferably designed so that when one cluster of three sets each is tilted forward, none of the other clusters can be tilted forward. In other words, the machine is preferably designed so that only one cluster can be tilted forward at one time. When one cluster is tilted forward, the remaining clusters are preferably locked in position. The number of sets that can be contained within a particular housing will vary with the diameter of the tubes and the number of tubes in each set. A larger housing can be designed to accommodate more sets.

Figure 2:
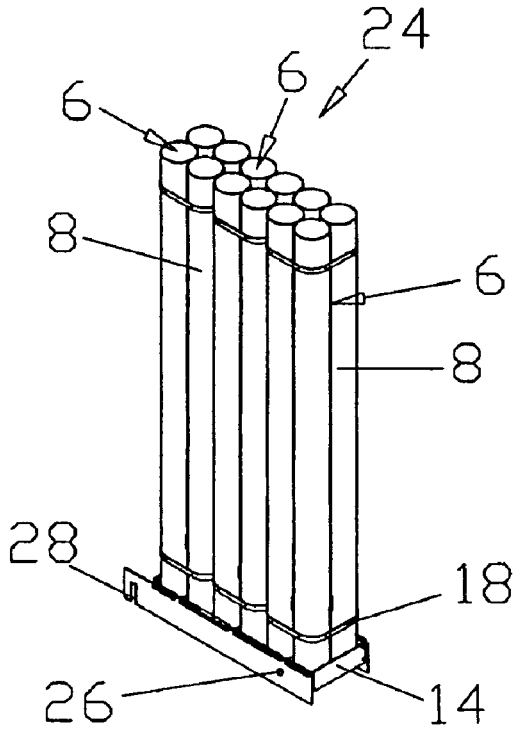
FIG. 2 is a perspective view of a cluster of three sets of tubes.

In FIG. 2, there is shown one cluster 24 of three sets 6 of tubes 8 mounted on the tiltable support 14. The support 14 has an opening 26 to receive a pivot rod (not shown). A rear of the tiltable support 14 has a slot 28 therein to receive a bar (not shown). When mounted in the housing, the clusters 24 can be tilted forward one at a time about the pivot bar for filling purposes. After the tubes have been filled, the clusters 24 can be tilted back into the housing one at a time. When the bar fully enters the slot 28, further rearward tilting will be prevented and the tubes will be substantially vertical. Each set of tubes is held together with straps 18.

Figure 3:
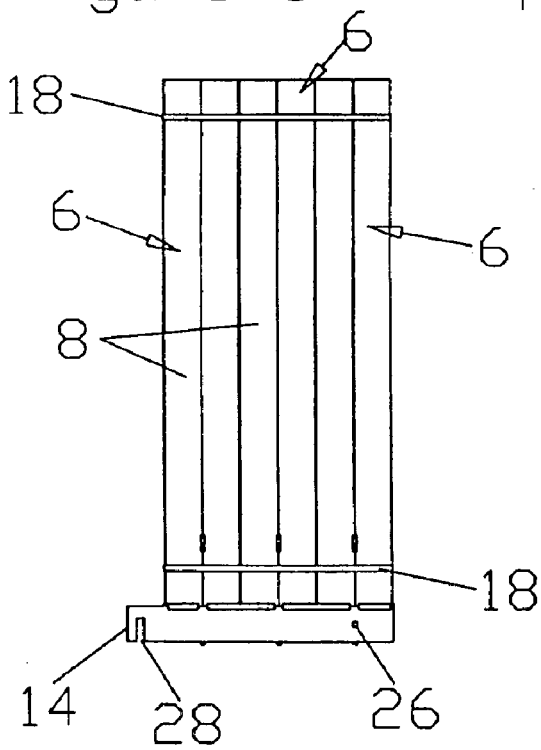
FIG. 3 is a side view of the cluster of FIG. 2.
Figure 4:
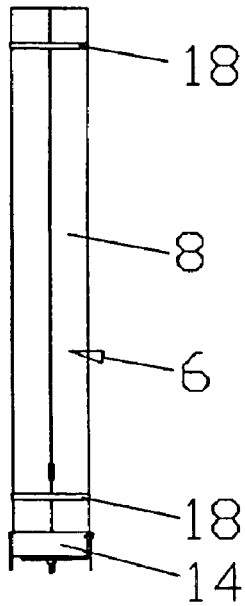
FIG. 4 is an end view of the cluster of FIG. 2.

In FIGS. 3 and 4, there is shown a side view and front view of the clusters 24. The same reference numerals are used in FIGS. 3 and 4 as those used in FIG. 2 to describe those components that are identical.

Figure 5:
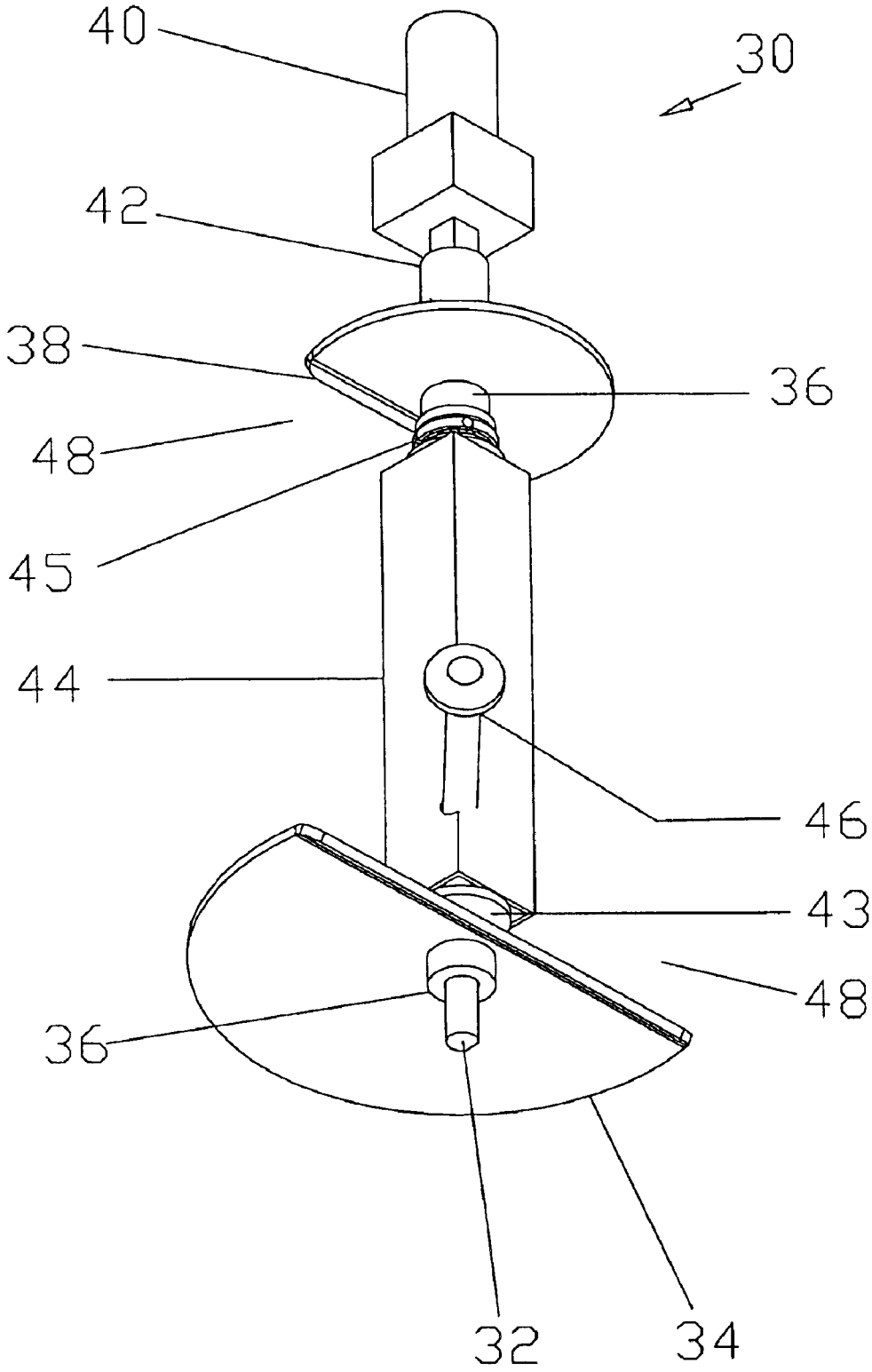
FIG. 5 is a perspective view of an actuator.
Figure 5A:
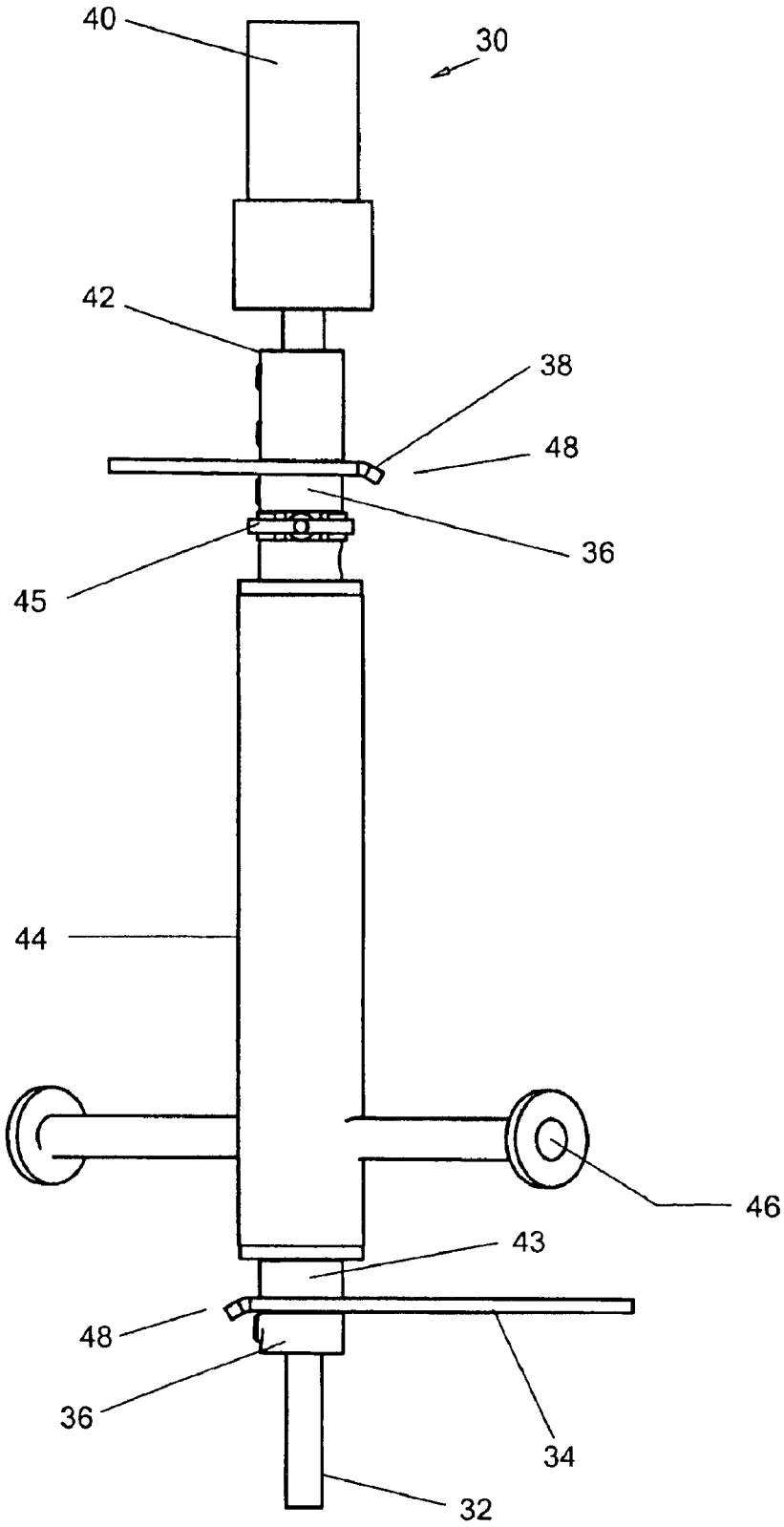
FIG. 5A is a side view of an actuator.

In FIG. 5, there is shown a perspective view of an actuator 30. In FIG. 5A, there is shown a side view of the actuator 30. The actuator 30 has a shaft 32 with a lower abutment 34 affixed to the shaft 32 by a locking collar 36 beneath the lower abutment 34. The locking collar 36 is welded to the lower abutment 34. The locking collar is locked in position on the shaft 32 by set screws (not shown) in FIG. 5. An upper abutment is held in position on the shaft 32 by a locking collar 36 located immediately beneath the abutment 38. The locking collar 36 is welded to the upper abutment 38. A motor 40 is mounted at the top of the shaft 32. The motor is connected to rotate the shaft about its longitudinal centre axis through a coupling 42. The shaft is mounted in a bearing 45 located beneath the upper abutment 38. A height of the lower abutment 34 on the shaft 32 is adjustable. A height of the upper abutment 38 in the embodiment shown is not adjustable, but the upper abutment could be designed to be adjustable. Since the lower abutment is adjustable, the distance between the two abutments is adjustable within a per-determined range. A centering collar 43 centres the shaft 32 within a sleeve 44. The sleeve 44 has a square cross section. The sleeve 44 surrounds the shaft 32 between the abutments 34, 38. Two projections 46 (only one of which is shown) extend out each side of the sleeve 44 between the tubes (not shown in FIGS. 5 and 5A) to support the actuator 30 and tubes on the support 14 (not shown in FIGS. 5 and 5A). Both the shape of the sleeve 44 and the projections 46 prevent the sleeve 44 from rotating. There is one actuator 30 mounted in each set of tubes. It can be seen that each of the abutments 34, 38 has a cutaway portion 48 on one side. It can also be seen that the cutaway portions 48 are oriented 180° apart from one another. There are many different ways that the actuator can be designed to achieve the desired result.

Figure 6:
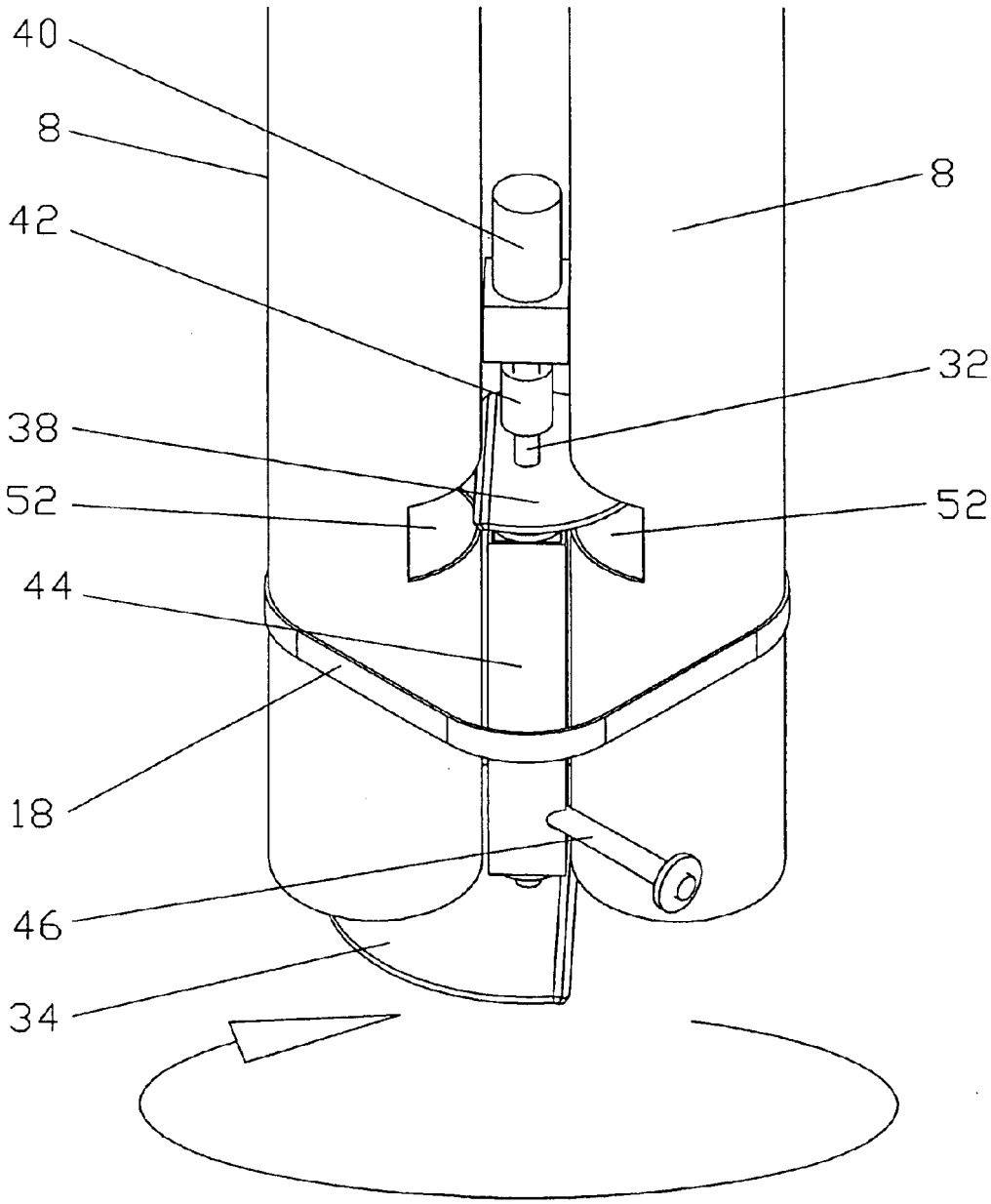
FIG. 6 is a partial perspective view of one set of tubes with a front tube removed to expose the actuator.

In FIG. 6, the actuator 30 is located between the tubes 8. The front tube has been omitted from FIG. 6 to expose the actuator. There are openings 52 located in the tubes 8 to accommodate the upper abutment 38. The shaft 32 and abutments 34, 38 rotate in a clockwise direction when viewed from a top. In FIG. 6, the actuator 30 is slightly different from the actuator 30 shown in FIGS. 5 and 5A as there is a gap between the coupling 42 and the upper abutment 38 of the actuator 30 in FIG. 6. The same reference numerals are used in FIG. 6 as those used in FIGS. 1 and 5. If it is desired to access the actuator for repairs or replacements, the straps 18 can be severed. When the repair is accomplished, the straps can be replaced to assemble the set.

Figure 7:
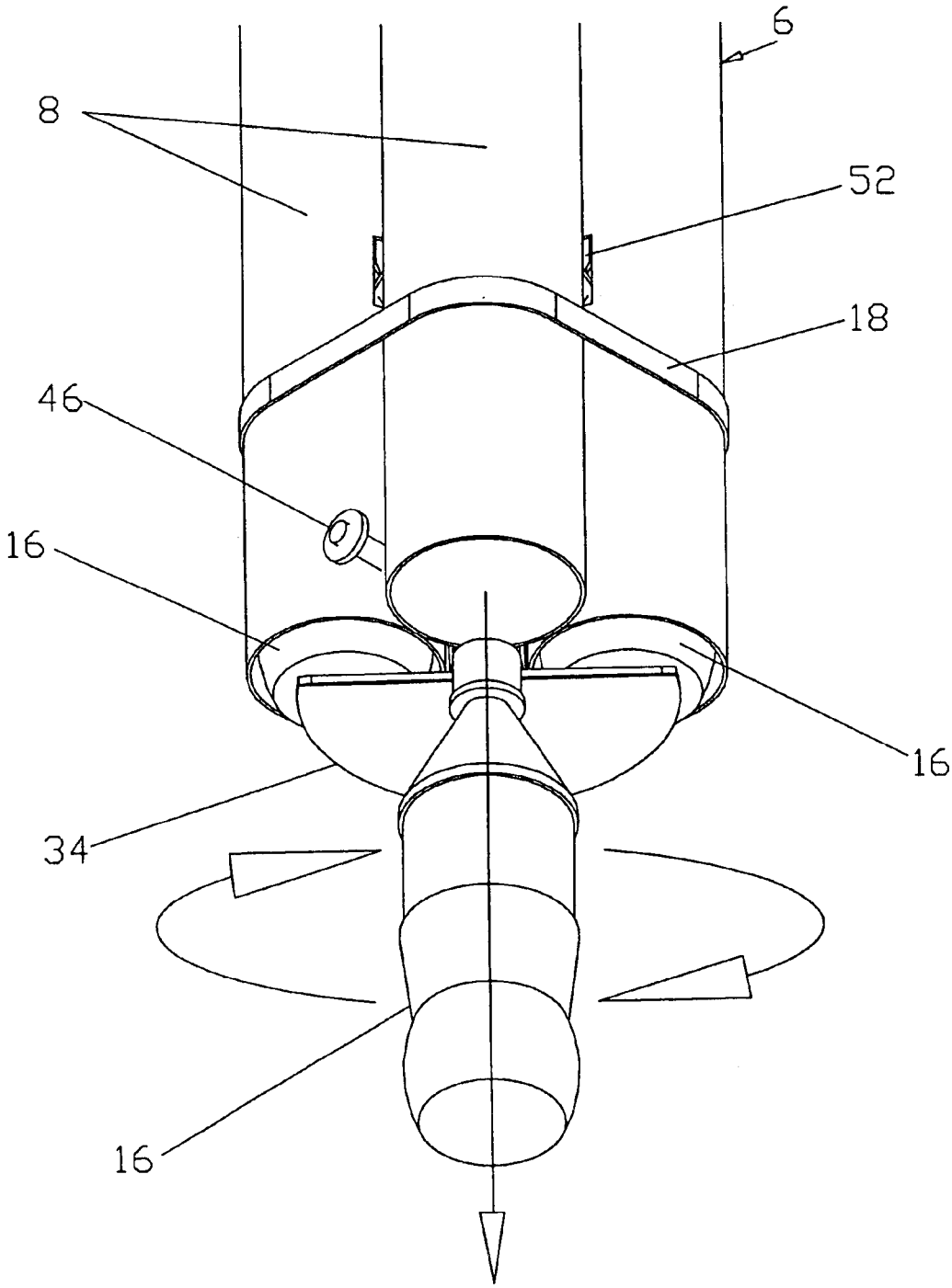
FIG. 7 is a partial perspective view of one set of tubes viewed from beneath the actuator.

In FIG. 7, there is shown a bottom view of the set 6 of four cylindrically shaped tubes 8. The same reference numerals are used in FIG. 7 as those used in FIGS. 1 and 6 to describe those components that are identical. It can be seen that a container 16 has exited the front tube 8 past the cutaway portion 48 of the lower abutment 34. The container 16 has passed by the lower abutment 34 and will fall to the outlet (not shown in FIG. 7). The containers in each of the remaining three tubes of the set 8 are prevented from exiting the tubes 8 by the lower abutment 34. It can be seen that there are containers 16 in the two side tubes 8. The rear tube 8 is not shown in FIG. 7, but the rear tube 8 would also have a container that is prevented from exiting the tube by the lower abutment 34.

Figure 8:
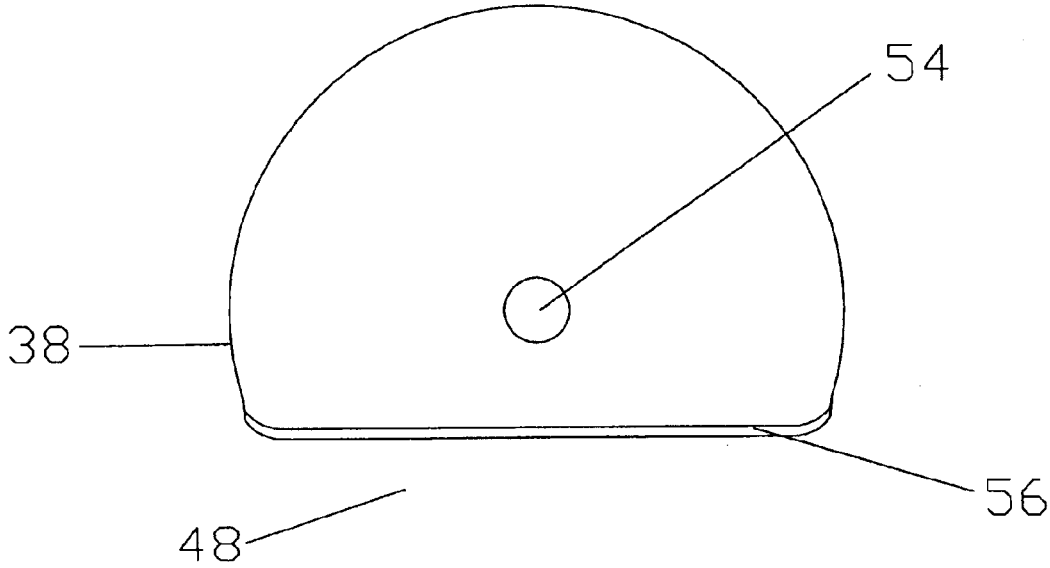
FIG. 8 is a top view of an upper abutment.
Figure 9:
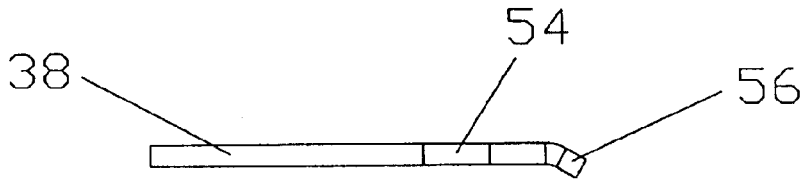
FIG. 9 is an edge view of the upper abutment.

In FIG. 8, there is shown a top view of the upper abutment 38 and in FIG. 9 there is shown an edge view of the upper abutment 38. It can be seen that the upper abutment 38 has an opening 54 therein to receive the shaft 32. A straight edge 56 is tilted downward as can be best be seen from FIG. 9. A cutaway portion 48 is located just beyond the straight edge 56. It can be seen that the upper abutment 38 has a shape similar to approximately two-thirds of a circle. The edge 56 is bent downward to add strength to the upper abutment 38.

Figure 10:
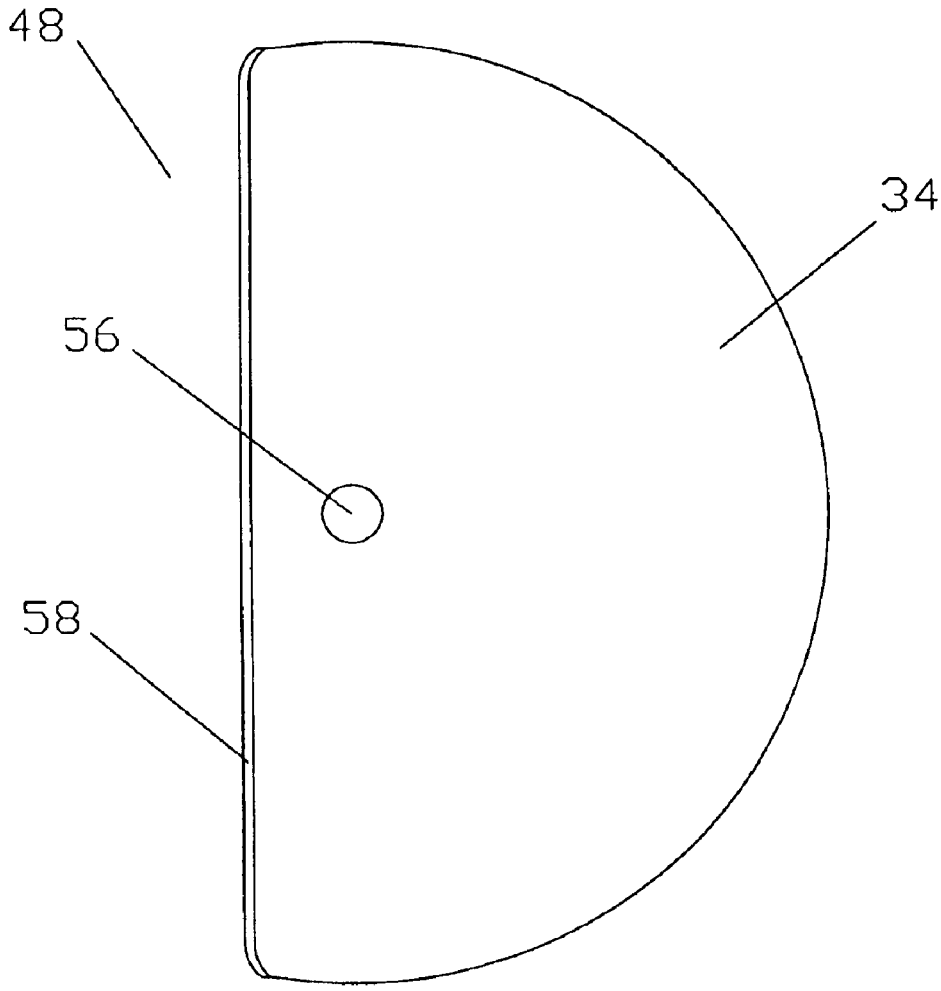
FIG. 10 is a top view of a lower abutment.
Figure 11:
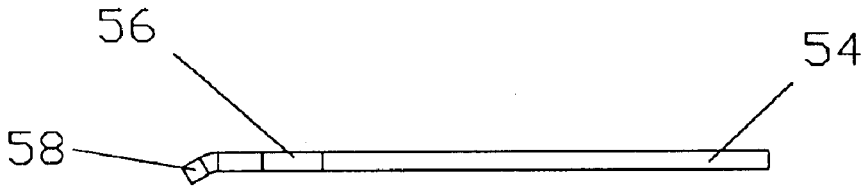
FIG. 11 is an edge view of the lower abutment.

In FIGS. 10 and 11, there is shown a top view of the lower abutment 34, together with an edge view of the lower abutment 34. It can be seen that the lower abutment 34 has an opening 56. An edge view of the lower abutment 34 is shown in FIG. 11. It can be seen from FIGS. 10 and 11 that the lower abutment 34 is significantly larger than the upper abutment 38. A straight edge 58 of the lower abutment 34 slopes slightly downward to add strength to the abutment 34. A cutaway portion 48 is located just beyond the straight edge 58. The lower abutment has a shape equal to approximately two-thirds of a circle.

Figure 12:
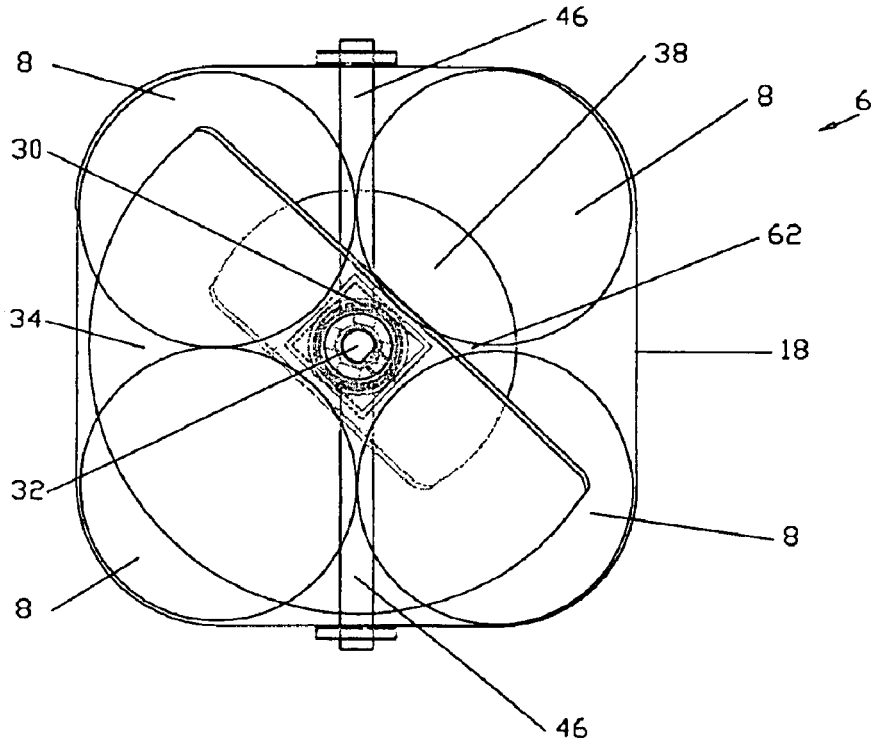
FIG. 12 is a schematic bottom view of a set having four cylindrical tubes.
Figure 13:
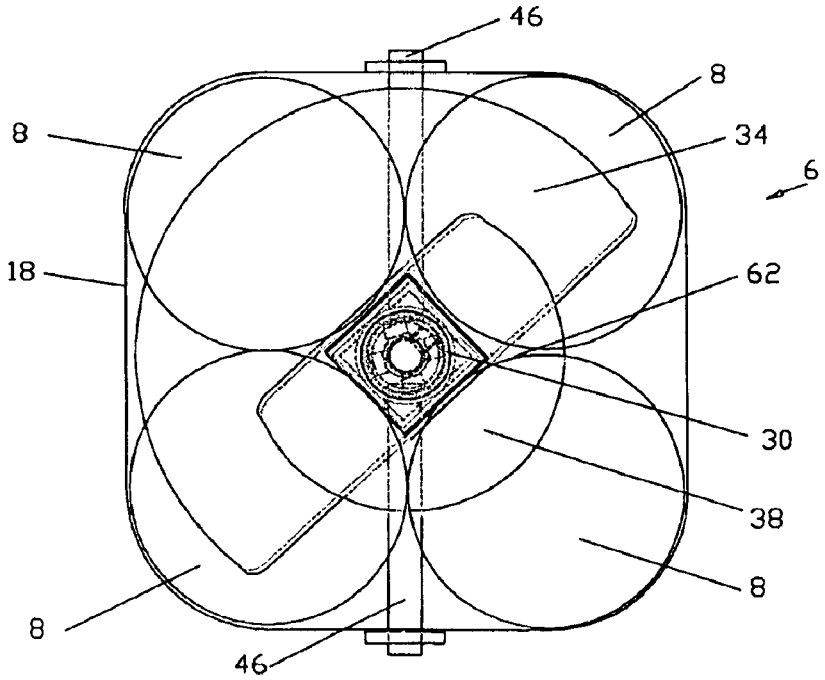
FIG. 13 is a schematic top view of the set of FIG. 12.

In FIG. 12, there is shown a bottom schematic view of a set 6 of four tubes 8. In FIG. 13, there is shown a schematic top view of a set 6 of four tubes 8. The actuator 30 fits within an interstice 62 between the four tubes 8. The same reference numerals are used in FIGS. 12 and 13 to describe those components that are identical to the components of FIGS. 1 and 5. The relative sizes and shapes of the lower abutment 34 and the upper abutment 38 is readily apparent. Also, it can be seen that abutments are oriented 180° apart from one another with the two straight edges facing in opposite directions. The cutaway portions 48 of the two abutments are also oriented 180° apart from one another. The abutments each have a shape similar to a segment of a circle. The projections 46 extend through part of the tubes 8. Since FIGS. 12 and 13 are schematic views, the thickness of the tube wall is not shown. In an actual assembly, the thickness of the tube walls takes up most of the thickness of the projections so that the projections extend only slightly into an interior of the tubes.

Figure 14:
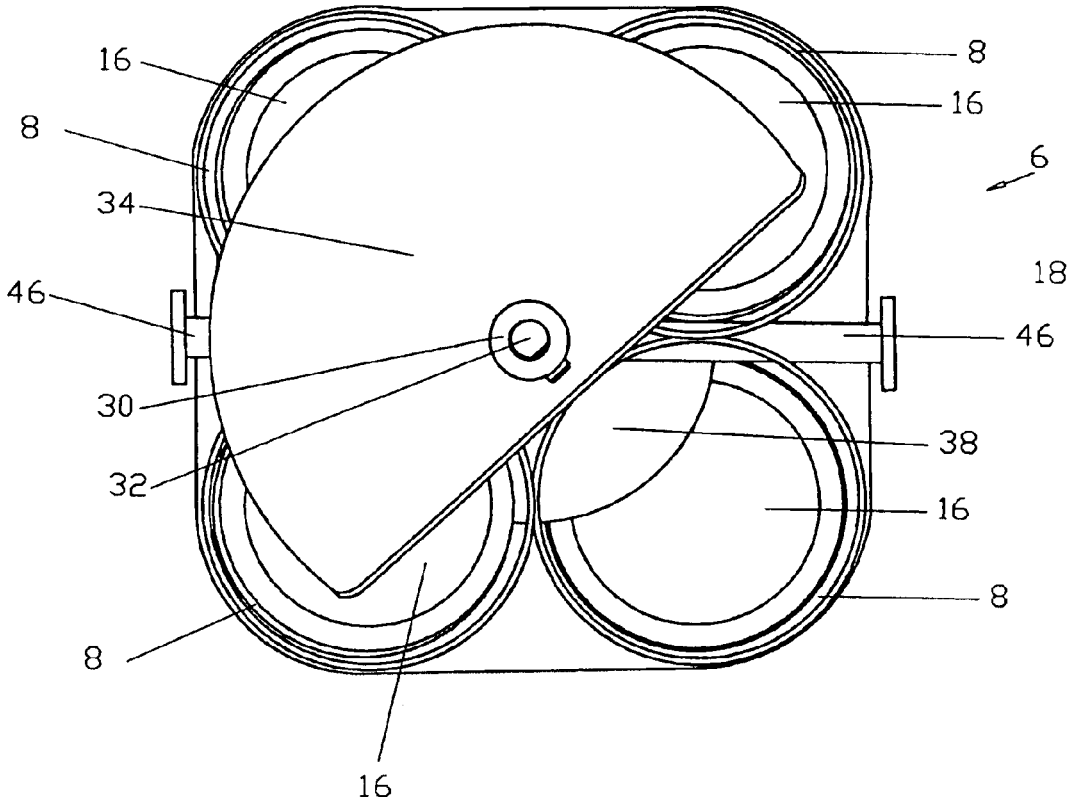
FIG. 14 is a bottom view of a set of four tubes with containers located in said tubes.

In FIG. 14, there is shown a bottom view of one set 6 of four tubes 8 with containers 16 in each of the tubes 8. The same reference numerals are used in FIG. 14 as those used in FIG. 12 to describe those components that are identical. It can be seen that the container 16 in the bottom right of FIG. 14 is supported by the upper abutment 38 and the remaining three containers in the other tubes 8 are supported by the lower abutment 34. In operation, the actuator moves 90° during each activation. The container in the tube 8 in the bottom right (not shown) that had been resting on the lower abutment 34 has been the most recent container to have passed by the lower abutment to the outlet (not shown in FIG. 14). When the abutments rotate 90° (counterclockwise when viewed from the bottom) in the next activation, the container 16 in the upper right will pass by the lower abutment to the outlet. When a set is filled with containers after being completely empty, one activation is required before the set will dispense a container. After rotating, the machine can be designed to stop dispensing containers when there is one container left on the lower abutment of each set. With this design, the set will dispense a container upon the first activation. The actuator is fixed vertically relative to said tubes by pressure from the tubes applied to the actuator from the straps.

Figure 15:
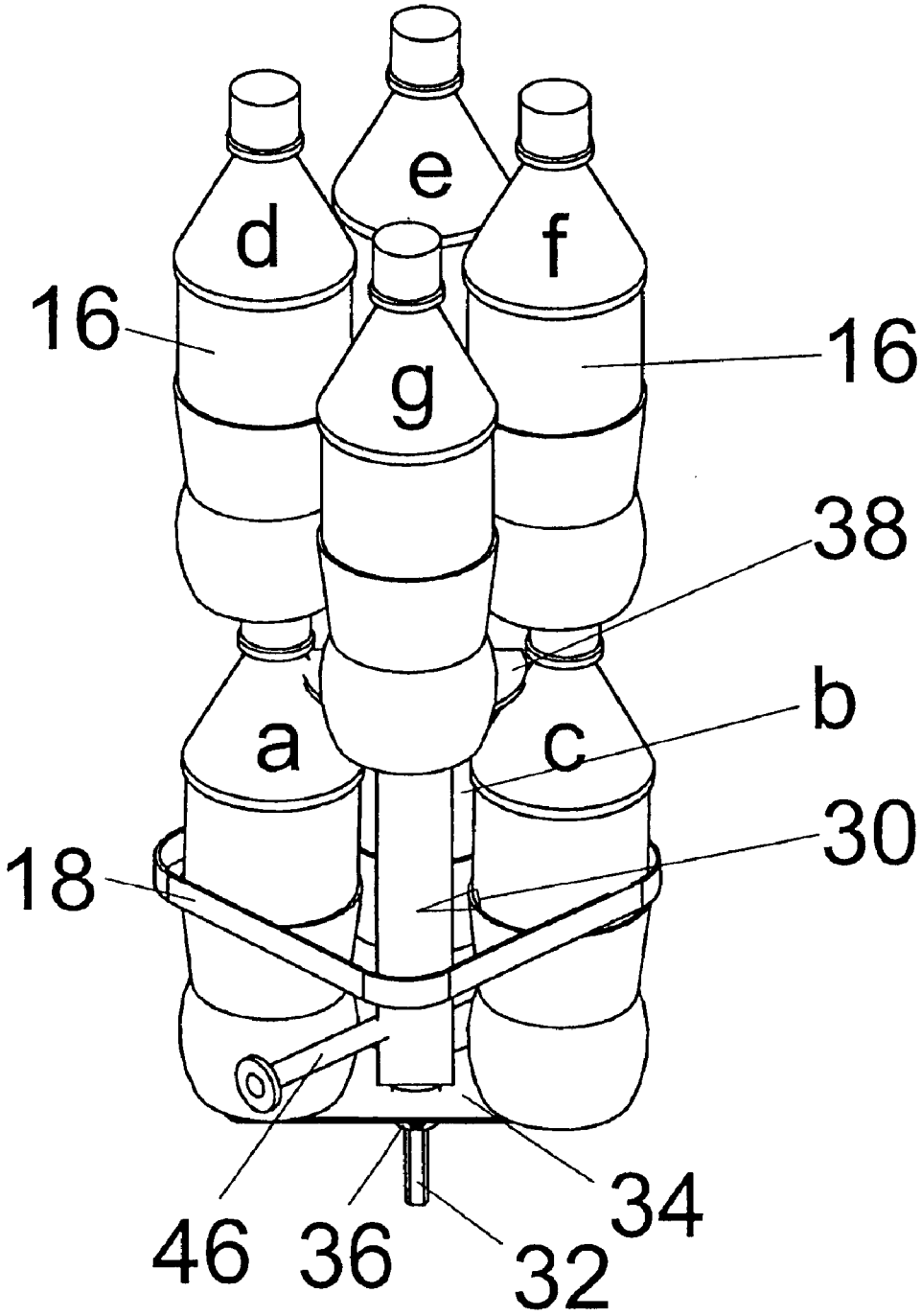
FIG. 15 is a schematic perspective view of containers on the actuator.
Figure 16:
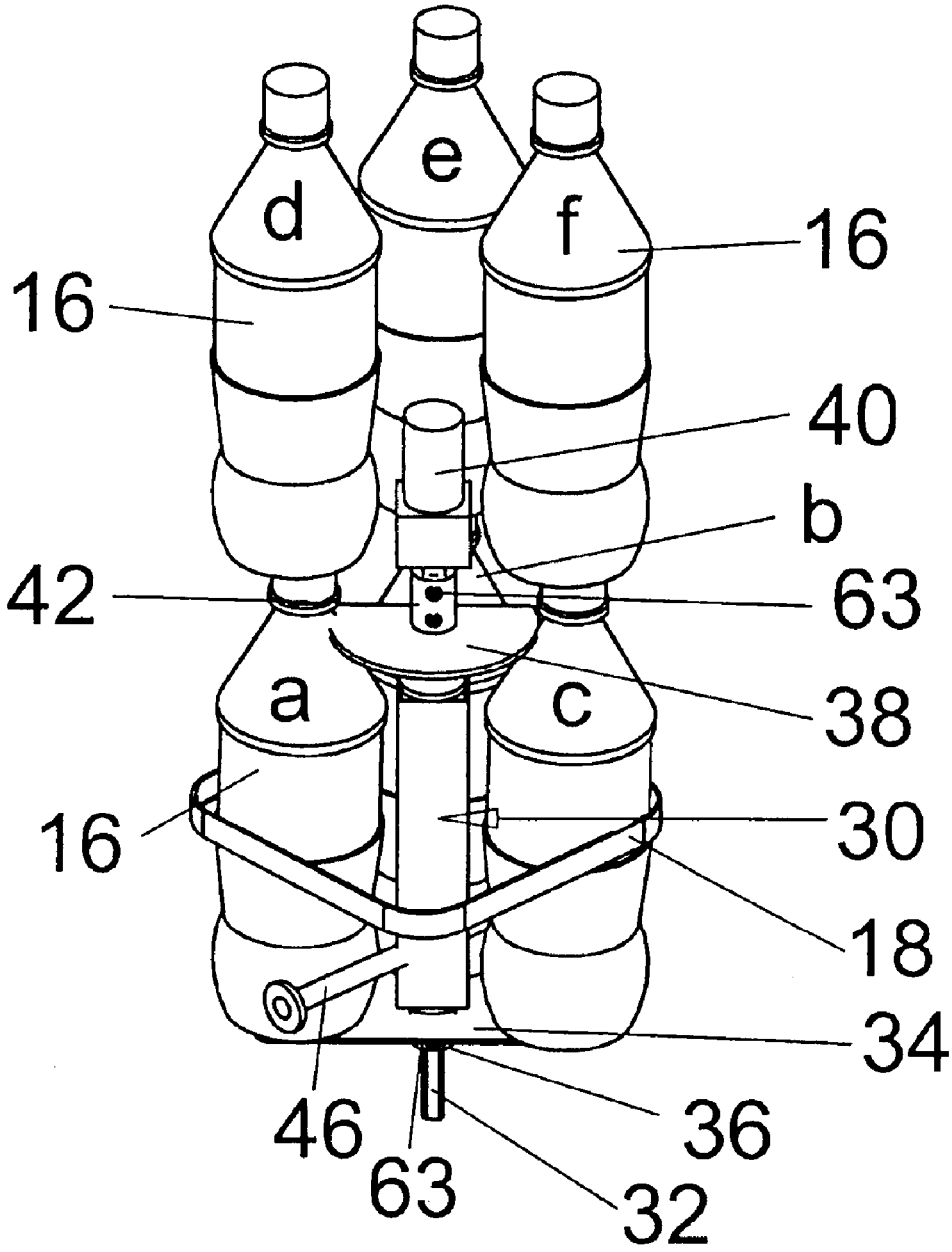
FIG. 16 is a schematic perspective view of the containers shown in FIG. 15 with an upper front container removed.

In FIG. 15, there is shown a schematic perspective view of seven containers 16 on the actuator 30 with the tubes removed to expose the containers and part of the actuator. In FIG. 16, there is shown a schematic perspective view of six containers 16 mounted on the actuator 30. The actuator is in the same position in FIGS. 15 and 16. The difference between the two figures is that the front container 16 on the upper abutment 38 shown in FIG. 15 has been removed in FIG. 16 to expose more of the actuator 30. The same reference numerals are used in FIGS. 15 and 16 as those in FIGS. 1 and 5 for those components that are identical. In FIG. 15, there are three containers 16 resting on the lower abutment 34, one at each side and one at the rear. The container that had been at the front on the lower abutment 34 would have fallen to the outlet upon the last activation of the actuator 30. On the upper abutment 38, only the front container 16 is actually resting on the abutment. The other three containers (the two containers at the side and the one container at the rear) are resting on the containers that are located immediately beneath each of those other containers. The containers have a neck that converges at the top and the top is narrower than the base. It can be seen that each of the containers 16 has a height that is greater than the distance between the two abutments 34, 38.

In FIG. 16, set screws 63 are shown on the coupling 42 and on the locking collar 36. For ease of explanation, the seven containers 16 shown in FIG. 15 are labelled 'a', 'b', 'c', 'd', 'e', 'f', 'g'. The six containers shown in FIG. 16 that are identical to the containers of FIG. 15 are labelled 'a', 'b', 'c', 'd', 'e', 'f' respectively. In the position shown in FIG. 15, the container at the front that had been resting on the lower abutment 34 immediately before the actuator 30 moved to the position shown in FIG. 15 has fallen past the lower abutment 34 to the outlet (not shown). The actuator can be set up to rotate either clockwise or counterclockwise, but, in the embodiment shown, the actuator always rotates in the same direction. Also, in the embodiment shown, the actuator rotates 90° for each activation. Assuming that the actuator 30 rotates in a clockwise direction when viewed from above, in the next activation from that shown in FIG. 15, the container 'a' will be above the cutaway portion 48 of the lower abutment 34 and will fall to the outlet (not shown). The container 'd' will fall onto the upper abutment 38. In the second activation from that shown in FIG. 15, the container 'b' will fall to the outlet and the container 'e' will fall onto the upper abutment 38. Simultaneously, the container 'g' will fall onto the lower abutment 34. In the third activation from that shown in FIG. 15, the container 'c' will fall to the outlet and the container 'f' will fall onto the upper abutment 38. Simultaneously, the container 'd' will fall onto the lower abutment 34. In the fourth activation from that shown in FIG. 15, the container 'g' will fall to the outlet. Simultaneously, the container 'e' will fall onto the lower abutment 34. As containers 'c', 'e', 'f', and 'g' fall onto the lower abutment 34, any containers in the tube (not shown) immediately above 'c', 'e', 'f', and 'g' will take the place of containers 'd', 'e', 'f' and 'g' in the position shown in FIG. 15, in succession. In other words, containers will be replenished from containers located in the same tube as long as containers are available.

Figure 17:
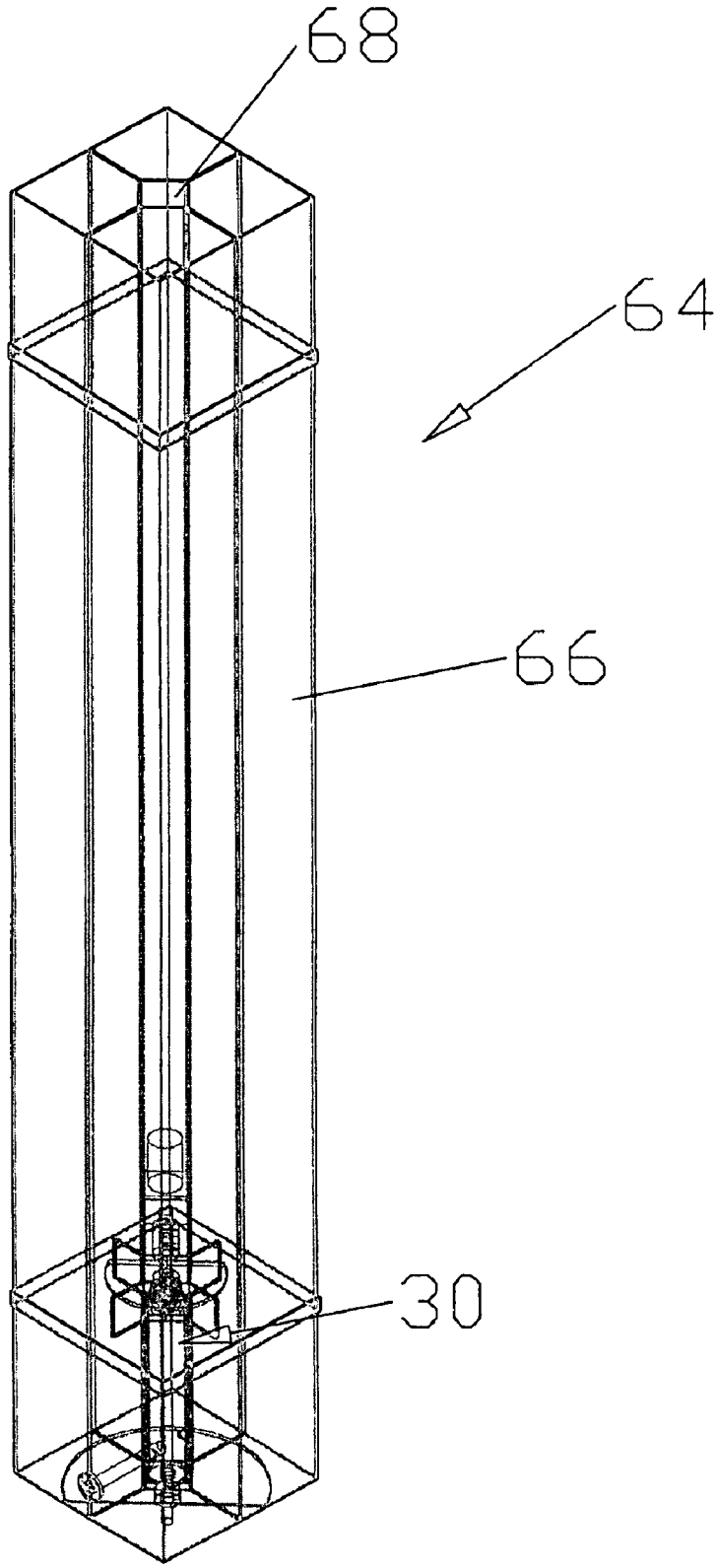
FIG. 17 is a perspective schematic view of a set of four tubes having a square cross section.

FIG. 17 shows a set 64 of four rectangular tubes 66. An interstice 68 for the actuator 30 is created by angling off an inner corner of each of the tubes 66. Except for the angled inner corner, the tubes would have a square cross section. The same reference numerals are used in FIG. 17 to describe those components that are identical to the components of FIGS. 1 and 5. The sets 65 operate in the same manner as the sets 6 with the cylindrically shaped tubes. The actuator 30 is identical to the actuator shown in FIG. 5 and is not described in detail. The square tubes can be used to dispense products having a rectangular shape, but tubes having a circular cross section can be used to dispense containers having a rectangular cross sectional shape as well. Similarly, containers having a circular cross section can be dispensed from square or rectangular tubes. The only requirement is that the containers fit properly within the tubes. It would not be desirable to have a container with an extremely small cross section dispensed from tubes having a relatively large cross section where there is a possibility that the containers within a tube will become misaligned with one another. For example, if the cross sectional area of the tube is so large relative to the cross sectional area of the container, that two containers could partially overlap, the columns might become jammed.

Each set 6 of four tubes 8 has one actuator 30 including one motor 40. Each of the motors is connected to selection means (not shown) so that when a consumer makes the deposit of an appropriate amount of money to the machine, the consumer can select the beverage in any one of the fifteen sets 6. When a particular set is activated, the motor for that set will rotate the actuator 90° and the container that is on the lower abutment 34 immediately before the cutaway portion will fall to the outlet as soon as the abutments rotate. The selection means and the wiring for the dispensing machine is not shown as it is conventional. The dispensing machine can contain heating means or refrigeration means depending on whether the machine is for hot or cold beverages. Usually, the containers will be bottles and will contain beverages. However, the dispensing machines can be used to dispense containers containing products other than beverages. The dispensing machine can also be used to dispense rectangular or square containers. The machine will dispense any diameter of container or any size of container as long as it is small enough to slide easily within the tubes and has a large enough cross section relative to the cross section of the tubes that it will not become misaligned with containers immediately above or below it to the extent that two or more containers will overlap. Containers must also have a smaller top than a base so that a top portion of a container can be located above the upper abutment when the container rests on the lower abutment. The distance between the two abutments must be less than the height of one container and, preferably, the container narrows at a neck thereof. Adjustments may have to be made to the machine when containers of a different height are used. The machine will accommodate containers of a different height within a certain size range without any adjustment being made. The distance between the abutments can be manually adjusted to extend the range of containers that can be dispensed by a particular actuator. To dispense containers having a height outside of the extended range, a different size actuator will have to be used. The manual adjustments of the actuator are limited by the sleeve 44 and by the length of the shaft 32. A completely different size range can be dispensed with a shorter or longer actuator than that shown in FIG. 5. As shown in the drawings, the containers must be taller than the distance between the lower abutment and the upper abutment and the container must be shaped so that the upper abutment does not damage the container as the upper abutment rotates. In other words, the neck of the container has to be narrow enough at the height of the upper abutment to allow the upper abutment to rotate without damaging the containers immediately adjacent to the upper abutment. If a container has a narrower base than a top, an actuator can be chosen with the appropriate distance between the abutments to dispose the containers.

The machine can dispense gable topped containers, for example milk cartons, with a small adjustment added to ensure that the gable topped containers are oriented correctly and the correct orientation is maintained. For example, in a machine with square or rectangular tubes, the tubes could be sized so that the milk cartons can be oriented correctly within the tubes when the tubes are filled and that orientation is maintained by the tubes themselves. Obviously, if the diameter of the tubes or cross sectional sides of the tubes is smaller in a particular machine, then many more sets of tubes can be included. Preferably, the machine is used to dispense containers having a size of approximately 600 millilitres or larger. Obviously, the larger the cabinet or housing or the smaller the diameter or size of the tubes, the greater number of sets of tubes that can be contained within the housing. There is preferably one selection for each set of tubes. A decision might be made to have more than one selection apply to the same product. Alternatively, the machine could be designed so that it has fewer selections than the number of sets and some selections are designed to operate more than one set. For example, if a manufacturer has a product that is much more popular than other products, the manufacturer might decide to design the dispensing machine so that a selection for the most popular product will dispense containers from, for example, four sets of tubes. The control must then be set up to empty the sets sequentially from the same selection. In other words, the actuators are activated for the first of the four sets until the first set is empty and so on until all four sets are empty. The preferred number of tubes in each set is four. However, sets can be designed to have fewer than four guides or more than four guides in each set. The offset between the upper and lower abutments relative to one another must be adjusted as the number of guides in each set changes.

Existing cabinets have inside dimensions of approximately 34.5 inches in width by 21 inches in depth. When tubes are used having an outside diameter of 3.5 inches, a total of twelve sets of tubes (four tubes per set) can be easily mounted within the cabinet. The present invention can be used with new installations or it can be used to retrofit existing cabinets. New cabinets are now available having an inside width of 36.5 inches and an inside depth of 22 inches. Fifteen sets of four tubes each having an outside diameter of 3.5 inches per tube can easily be mounted within the new cabinet. This provides a maximum of fifteen selections. Tubes having an outside diameter of 3.5 inches can accommodate plastic containers having a volume of approximately 600 millilitres quite readily. The sizes provided are examples only and the invention is not limited to particular sizes or particular dimensions. Other vertical guides could be used in place of the tubes shown. However, tubes are believed to be the most cost effective. While the embodiment shown in the drawings with four tubes per set rotates 90° for each activation and has the cutaway portions offset by 180°, the cutaway portion of the upper abutment could be offset from the cutaway portion of the lower abutment by 90° instead of 180°. In that event, the vertical offset of the abutments would equal the activation distance. An advantage of the present invention is that the sides of the container can be completely redesigned without requiring any adjustment to the machine.

I claim:

1. A container dispensing machine for storing and dispensing containers longitudinally, where each container has a base and a top, said top being smaller than said base, said dispensing machine comprising a plurality of vertical guides arranged in at least one set, said vertical guides being sized so that a plurality of containers can fit within each of said guides longitudinally with said base being located beneath said top, two abutments rotatably mounted in a plane substantially normal to a longitudinal centre axis of said at least one set, an actuator connected to rotate said two abutments by part of one turn in said plane for each activation, each of said two abutments having a cutaway portion, said two abutments being an upper abutment and a lower abutment, said abutments being oriented so that the cutaway portion of said upper abutment is vertically offset from the cutaway portion of said lower abutment by at least the distance that said two abutments rotate in one activation, said abutments rotating about said longitudinal centre axis of said at least one set, said upper abutments being sized to rotate without damaging containers on said lower abutment, said abutments being vertically separated by less than a height of one container, said vertical guides having an opening therein corresponding to a level of said upper abutment to allow said upper abutment to pass through said guide means, said dispensing machine having an outlet for any containers that pass said lower abutment.

2. A dispensing machine is claimed in claim 1 wherein each said two upper abutments is sized and located to block a passage of containers through all of said vertical guides except one.

3. A dispensing machine is claimed in claim 2 wherein said containers have a neck that is narrower than a body of said containers, said upper abutment being smaller than said lower abutment.

4. A dispensing machine as claimed in claim 1 wherein said lower abutments is located beneath all of said containers that are being retained in said machine.

5. A dispensing machine is claimed in any one of claim 1, 2 or 4 wherein said abutments are mounted on a vertical shaft, said shaft being rotatable by said actuator.

6. A dispensing machine is claimed in any one of claim 1, 2 or 4 wherein said abutments are mounted on a vertical shaft, said shaft being rotatable by said actuator and said actuator includes a motor, there being a separate motor for each set of said at least one set.

7. A dispensing machine is claimed in any one of claim 1, 2 or 4 wherein each abutment has a straight edge adjacent to said cutaway portion.

8. A dispensing machine is claimed in any one of claim 1, 3 or 4 wherein said vertical guides are tubes.

9. A dispensing machine is claimed in any one of claim 1, 3 or 4 wherein there is a space along said longitudinal centre axis of each set and a vertical shaft and motor to rotate said shaft is mounted within said space, said abutments being mounted on said shaft.

10. A dispensing machine is claimed in any one of claim 1, 3 or 4 wherein the vertical guides are tubes and said tubes have a cross-sectional shape selected from the group of circular, rectangular and square.

11. A dispensing machine is claimed in claim 1 wherein each of said two abutments is shaped to at least partially block all of said vertical guides but one after each activation.

12. A dispensing machine is claimed in claim 1 wherein there are four vertical guides in each set with a space between said guides along said longitudinal axis.

13. A dispensing machine is claimed in claim 12 wherein said actuator is constructed to rotate said abutments 90° for each activation, said cutaway portions being 180° apart from one another.

14. A dispensing machine is claimed in claim 12 wherein said abutments have a shape approximately equal to two-thirds of a circle.

15. A dispensing machine is claimed in claim 1 and said abutments are mounted on a shaft, said upper abutment being adjustably mounted so that a distance between said upper abutment and said lower abutment can be varied to accommodate containers of different vertical sizes.

16. A dispensing machine is claimed in claim 1 wherein said upper abutment extends into said vertical guides as said abutments rotate, said upper abutment preventing bases of containers in all but one of said vertical guides from moving downward upon each activation.

17. A dispensing machine is claimed in claim 16 wherein said lower abutment is sized and located to prevent the bases of all of the containers in all but one of the vertical guides from moving downward past the lower abutment to said outlet, each container passing said abutments through said cutaway portion.

18. A dispensing machine is claimed in claim 1 wherein there are a plurality of sets of said at least one set in said dispensing machine, each set comprising a different selection.

19. A dispensing machine is claimed in claim 1 wherein there are at least twelve sets in said dispensing machine, each set having an actuator including a motor and a selector connected to permit selection of one container from any of said sets upon each activation.

20. A dispensing machine is claimed in claim 1 wherein there are at least fifteen sets in said dispensing machine, each set having an actuator including a motor and a selector connected to permit selection of one container from any of said sets upon each activation.

21. A dispensing machine as claimed in any one of claim 1, 2 or 4 wherein all of said plurality of sets is mounted within a housing.

22. A dispensing machine as claimed in any one of claim 1, 2 or 4 wherein all of said plurality of sets is mounted within a housing, said sets being divided into a plurality of clusters of more than one set, each cluster being tiltable forward in succession within said housing to permit sets of each cluster to be filled with containers.

23. A dispensing machine as claimed in claim 1, 2 or 4 wherein said sets are held together with straps.

24. A dispensing machine as claimed in any one of claim 1, 2 or 4 wherein each set can store at least twelve containers.

25. A dispensing machine as claimed in any one of claim 1, 2 or 4 wherein each set can store at least twenty-four containers.

26. A method of dispensing containers from a dispensing machine, said containers being stored and dispensed longitudinally from vertical guides within a housing of the machine, said containers having a base and a top with said top being smaller than said base, said method comprising arranging a plurality of said vertical guides in at least one set, locating two abutments in a plane normal to a longitudinal centre axis of said at least one set, mounting said abutments vertically apart from one another, locating a cutaway portion in each abutment, offsetting the cutaway portions from one another, locating said abutments on any actuator to rotate said abutments, filling said guides with containers and activating said actuator to dispense the containers from said at least one set, at a ratio of one container for each activation.

* * * * *